US005469687A

United States Patent [19]

Olson

[11] Patent Number: 5,469,687

[45] Date of Patent: Nov. 28, 1995

[54] APPARATUS FOR FORMING STACKED ARTICLE GROUPS UTILIZING CLIP-TYPE CARRIERS

[75] Inventor: Allen L. Olson, Crosby, Minn.

[73] Assignee: Riverwood International Corporation, Denver, Colo.

[21] Appl. No.: 155,433

[22] Filed: Nov. 19, 1993

[51] Int. Cl.[6] ..... B65B 27/04; B65B 35/50; B65B 61/14

[52] U.S. Cl. ..... 53/48.1; 53/48.7; 53/171; 53/540; 53/134.1

[58] Field of Search ..... 53/48.1, 413, 540, 53/543, 48.7, 48.2, 48.3, 171, 134.1

[56] References Cited

U.S. PATENT DOCUMENTS

| | | | |
|---|---|---|---|
| 3,176,442 | 4/1965 | Ganz . | |
| 3,302,364 | 2/1967 | Rice | 53/48.1 X |
| 3,426,501 | 2/1969 | Earp | 53/48.1 |
| 3,431,826 | 3/1969 | Gentry . | |
| 3,660,961 | 5/1972 | Ganz . | |
| 3,850,282 | 11/1974 | Calvert . | |
| 4,078,357 | 3/1978 | Ida | 53/48.1 X |
| 4,169,343 | 10/1979 | McArdle . | |
| 4,646,908 | 3/1987 | Gambetti | 53/540 X |
| 4,693,055 | 9/1987 | Olsen, Jr. et al. | 53/48.1 X |
| 4,931,131 | 6/1990 | Thompson | 53/540 X |
| 4,947,624 | 8/1990 | Cones, Sr. et al. | 53/540 |
| 5,101,956 | 4/1992 | Gambetti | 53/540 X |
| 5,184,448 | 2/1993 | Kazlauskas . | |
| 5,282,348 | 2/1994 | Dampier et al. | 53/48.1 X |
| 5,359,830 | 11/1994 | Olson | 53/398 |

*Primary Examiner*—Horace M. Culver
*Attorney, Agent, or Firm*—Joel D. Skinner, Jr.; Steve McLary

[57] ABSTRACT

An apparatus and method for forming stacked article groups utilizing clip-type article group carriers. The overall apparatus is aligned in a generally linear, continuous orientation. The apparatus longitudinally moves infeed cans from an infeed end to an output end. The apparatus generally comprises (a) an article grouping and clip-type carrier application assembly having at least one input and first and second output lines; (b) a first conveyor disposed to receive and transport first article groups having clip-type carriers attached thereto from and first output line, the first article groups being transported at a first vertical level; (c) a second conveyor disposed to receive and transport second article groups having clip-type carriers attached thereto from the second output line, the second article groups being transported at a second vertical level which is above the first vertical level; and (d) means to merge the second article groups over the top surface of the first article groups.

20 Claims, 12 Drawing Sheets

APPARATUS FOR FORMING STACKED ARTICLE GROUPS UTILIZING CLIP-TYPE CARRIERS

BACKGROUND OF THE INVENTION

1. Field of the Invention

This invention relates to packaging methods and apparatus. Particularly, this invention relates to a method and apparatus for forming stacked or multiple layer article groups utilizing clip-type carriers. The packaging method and apparatus of the present invention is usable to package different types, styles and sizes of cans such as beverage cans, in a wide range of stacked group patterns, and in a fast and reliable manner. The clip-style packaging structures utilized in this invention provide the benefits of using less packaging material than presently used cartons, and of an environmentally friendly media. Stacked packages provide various advantages in terms of shipping, storage, advertising and marketing.

2. Background Art

Plastic ring structures or can clips presently being utilized to join or clip articles together to form carriers have been found to present environmental problems, relating to waste management and endangerment of wildlife. Applicants' assignee has developed clip-type carriers which are comprised of recyclable and ecologically safe paperboard. These clip-type carriers are disclosed in U.S. Pat. No. 5,282,348 entitled, "Clip-Type Article Carrier and Method of Manufacture." Apparatus for assembling the carriers has also been developed and disclosed in U.S. Pat. No. 5,359,830, which is hereby incorporated by reference. However, insofar as is known, no one has proposed or developed a method or apparatus for utilizing clip-type carriers to form and package stacked or layered article groups, particularly stacked groups of beverage cans.

In view of the limitations and shortcomings of prior art processes and apparatus, it is an object of this invention to provide a method of reliably forming stacked product groups at high speed. A particular object of the invention is to provide an apparatus and method for forming stacked or multiple layer beverage container groups utilizing clip-type carriers.

SUMMARY OF THE INVENTION

The present invention provides an apparatus and method for forming stacked article groups utilizing clip-type article group carriers. The overall apparatus is aligned in a generally linear, continuous orientation. The apparatus longitudinally moves infeed cans from an infeed end to an output end. The apparatus generally comprises (a) an article grouping and clip-type carrier application assembly having at least one input and first and second output lines; (b) a first conveyor disposed to receive and transport first article groups having clip-type carriers attached thereto from and first output line, the first article groups being transported at a first vertical level; (c) a second conveyor disposed to receive and transport second article groups having clip-type carriers attached thereto from the second output line, the second article groups being transported at a second vertical level which is above the first vertical level; and (d) means to merge the second article groups over the top surface of the first article groups.

In a one embodiment, the first and second conveyors are disposed side by side of one another, and the means to merge comprises an angled segment of the second conveyor which intersects the first conveyor at a predetermined angle. In another embodiment, the first and second conveyors are disposed in-line with one another, and the means to merge comprises a terminal end of the second conveyor, whereby article groups traveling on the second conveyor drop off the terminal end onto synchronized article groups traveling on the first conveyor. The output lines from the article grouping and clip-type carrier application assembly may be at the same or vertically distinct levels. The apparatus may further comprise means to apply a fastener to the top surface of each first and second article group, the means to apply a fastener being disposed upstream of the means to merge.

The article grouping and clip-type carrier application assembly comprises a first conveyor parallel and side by side infeed conveyors, infeed timing screw assemblies, first overhead containment belt assemblies, side transfer conveyors (2nd) and lane dividers. The apparatus further comprises base panel rotary placers, base panel overhead transfer systems, second overhead containment belt assemblies, outside chime locking wheel assemblies and inside chime locking wheel assemblies. These later elements, along with the timing screw assemblies and the first overhead containment belt assemblies, are disposed on an upper frame structure, the position of which is vertically adjustable for use with varying container sizes and configurations.

The benefits of this invention will become clear from the following description by reference to the drawings.

DESCRIPTION OF THE PREFERRED EMBODIMENT

Figure 4:
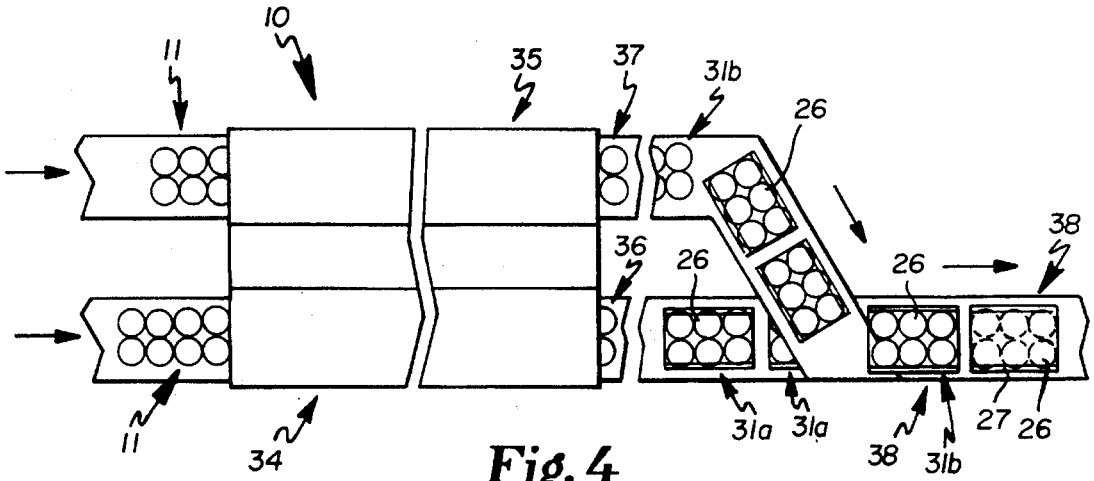
FIG. 4 is a top view of the packaging apparatus of this invention.
Figure 5:
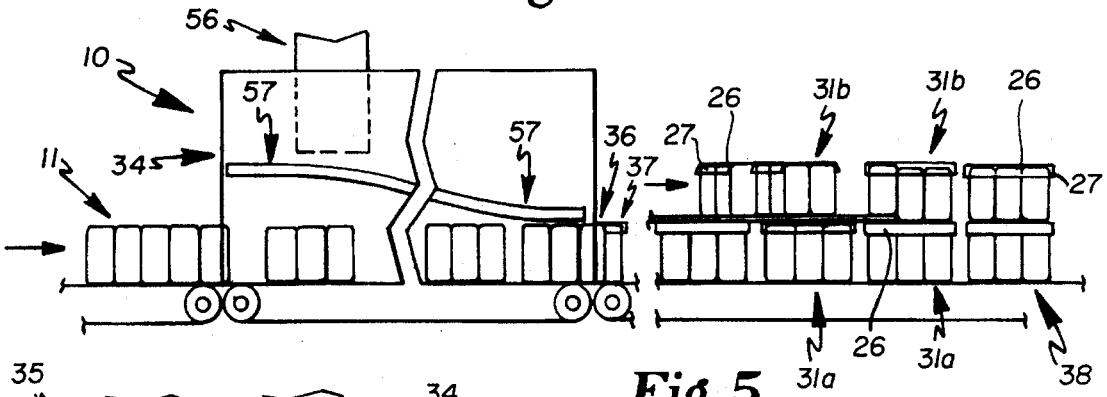
FIG. 5 is a side view of the packaging apparatus.
Figure 6:
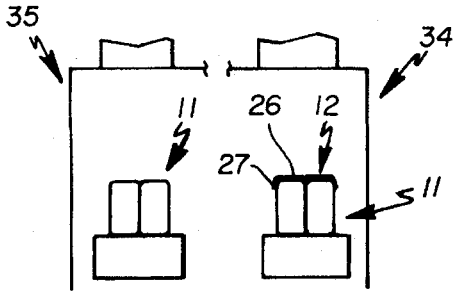
FIG. 6 is an end view of the packaging apparatus.

The process and apparatus of the present invention are for forming stacked article groups in a high speed packaging operation. The method of this invention is implemented via a high-speed packaging apparatus 10, the preferred embodiment of which is shown in FIGS. 4–6. The apparatus 10 is adjustable to provide reliable, continuous and high speed packaging of cylindrical containers of varying types, sizes and quantities into packages of varying types and sizes. For example, the apparatus 10 is usable to load standard twelve ounce beverage cans into 8 (4/4), 12 (6/6), 16 (8/8) and 24 (12/12) pack stacked combinations.

Figure 2:
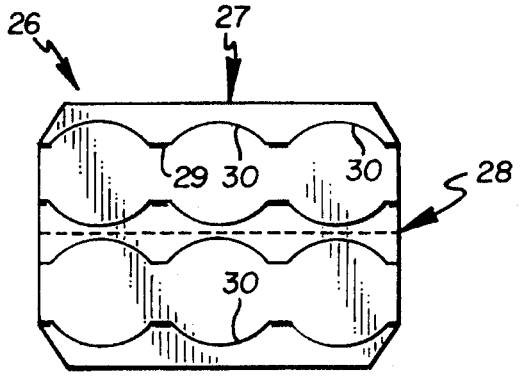
FIG. 2 is a top view of a clip-type packaging member utilized in the apparatus and method of this invention.
Figure 3:
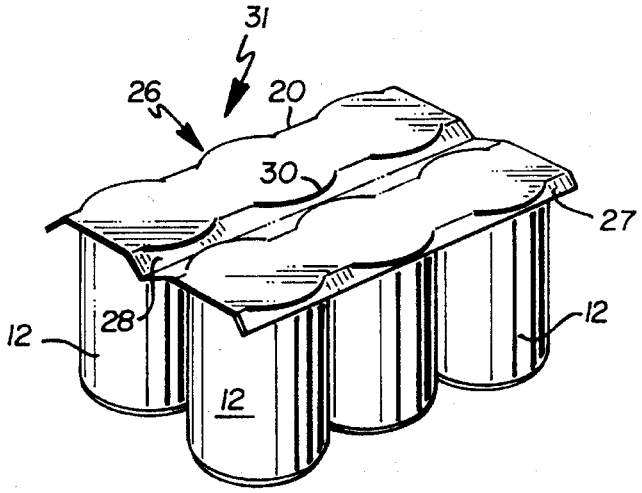
FIG. 3 is a perspective view of the clip-type packaging member connected to a single layer group of beverage cans.

The packaging system utilizes paperboard clip-type carriers such as those disclosed in the above-referenced pending U.S. patent application of Applicants' assignee. Referring to FIGS. 2 and 3, each clip-type carrier 26 couples with the top of a single layer can 12 group. The clip or panel 26 has a pair of parallel flat surfaces defined by opposing rows of interconnected fold lines 29 and curved chime engaging slits 30. A depressable central rib 28 separates the two flat surfaces, while side reinforcing strips 27 delineate the periphery of the panel 26.

Figure 1:
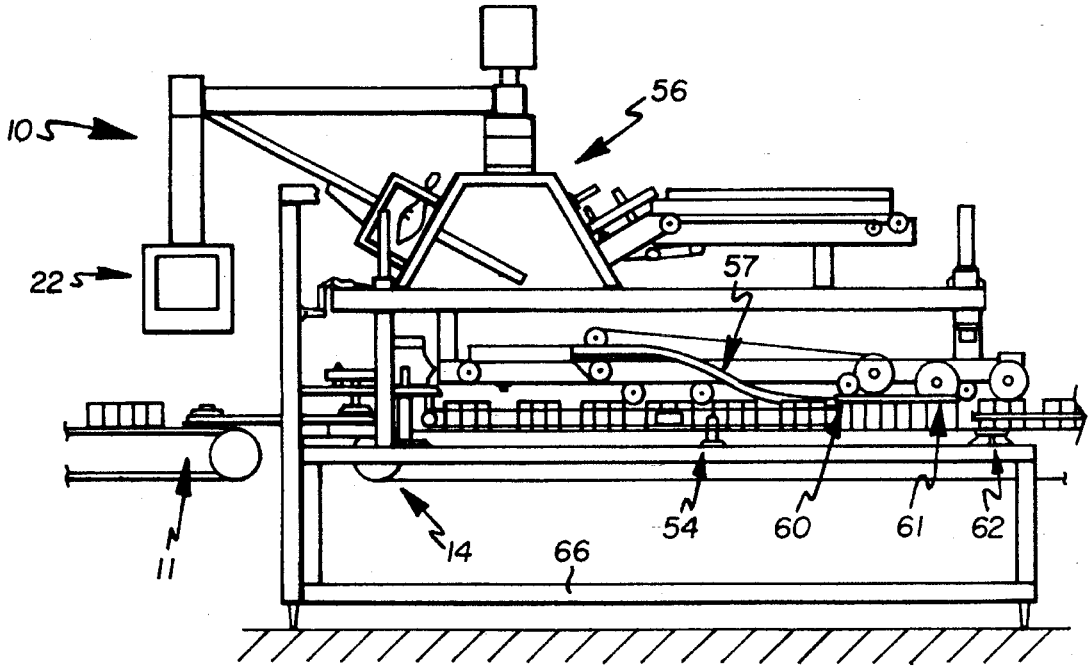
FIG. 1 is a side view of a mechanism which is part of the overall packaging apparatus of the present invention.

FIG. 1 shows the basic mechanism of the apparatus 10 for assembling two side by side oriented 6-pack single layer groups of beverage cans. Subsequently, a pair of such groups are aligned on top of one another and connected to construct a stacked 12-pack carrier. The mechanism longitudinally moves infeed cans 12 from an upstream or infeed end to a downstream or output end. The articles 12 are transported in a pair of parallel, side by side lanes or conveyance paths 34 and 35. The lanes 34 and 35 are further defined by a pair of throughput conveyors 52 which extend longitudinally and are disposed a the same vertical level. In an alternative embodiment, the conveyors 52 and the associated mechanisms which process ungrouped cans and can groups 31*a* and 31*b* conveyed thereon, are disposed at vertically distinct levels. In such an orientation, for example, line 35 is disposed at a higher level that line 34. This arrangement would obviate the need for elevation of the can groups 31*b* at the output of the mechanism as is described in detail below.

The containers 12 are shown delivered to the input end via a conveyor apparatus 48 which is part of tan upstream beverage container filling process. The mechanism is constructed on and supported by a unitary frame structure. The mechanism generally comprises parallel and side by side infeed conveyors 49, infeed timing screw assemblies 53, first overhead containment belt assemblies 54, side transfer conveyors 55 (2nd) and lane dividers 65. These elements basically cooperate with the throughput conveyor 52 to meter and transport container groups through the mechanism. The mechanism further comprises base panel rotary placers 56, base panel overhead transfer systems 57, second overhead containment belt assemblies 60, outside chime locking wheel assemblies 61 and inside chime locking wheel assemblies 62. The later elements align base panels 26 with the moving can groups and engage the panels 26 with the top surface of a group at a predetermined point. Also, these later elements, along with the timing screw assemblies 53 and the first overhead containment belt assemblies 54, are disposed on an upper frame structure 67, the position of which is vertically adjustable for use with varying container sizes and configurations.

FIGS. 4, 5 and 6, show the overall apparatus comprising a unitary mechanism such as that described above and having a pair of side by side product lines 34 and 35 which are disposed at the same level or plane. Each line is fed ungrouped cans 12 by infeed lines 11 and outputs a single level can group 31*a* and 31*b* which is mated with a carrier panel 26. A pair of outfeed lines or conveyors 36 and 37 is disposed at the downstream end of the mechanism, aligned with the product lines 34 and 35, respectively. In a preferred embodiment, fastening means such as tape (see for example FIG. 7) is applied to the top surface of each base panel 26 at a predetermined point along each line 36 and 37 to lock each panel 26 in place on its mated can group. The lines 36 and 37 are initially disposed at the same vertical level at the point where they meet the product lines 34 and 35. Outfeed line 36 remains at the same level and is shown to be oriented linearly for a predetermined downstream distance. In contrast, outfeed line 37 is elevated through a predetermined downstream distance such that the bottom surface of can groups 31*b* are level with the top surface of can groups 31*a* traveling on line 36. Also, at a predetermined downstream point where the can groups 31*b* are in the proper elevated level, line 37 is angled so that it merges with line 36. At this point, successive high groups 31*b* are deposited on the top surfaces of aligned and synchronized low groups 31*a* to form stacked groups 38. Lane elevation and lane merging may be accomplished by mechanisms and techniques which are well know in the packaging art. The stacked groups 38 are shown to be transported linearly downstream. Downstream processing, for example via a Sleever mechanism or a wrapping mechanism known in the art, results in a completed stacked carrier.

Figure 7:
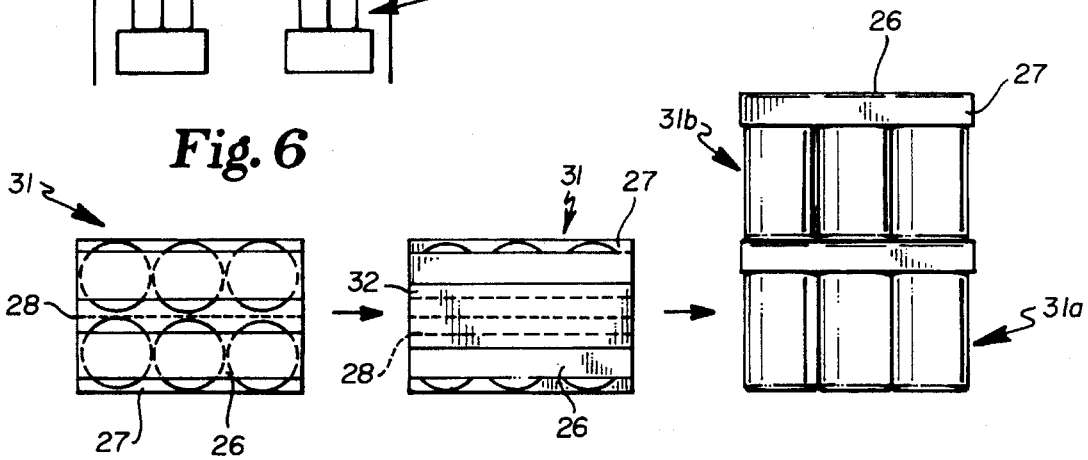
FIG. 7 is a flow diagram showing the steps of the method of this invention.

FIG. 7 is a flow diagram showing the basic steps of the method of this invention, wherein paperboard clip-type members are mated with article groups. Subsequently, a fastener, such as a tape member 32, may be applied to the top of each clip 26 to stabilize its center rib 28. A pair of can groups 31*a* and 31*b* are then aligned at two different vertical levels and merged together to form a stacked group 38.

Figures 8, 9, 9A, 9B:
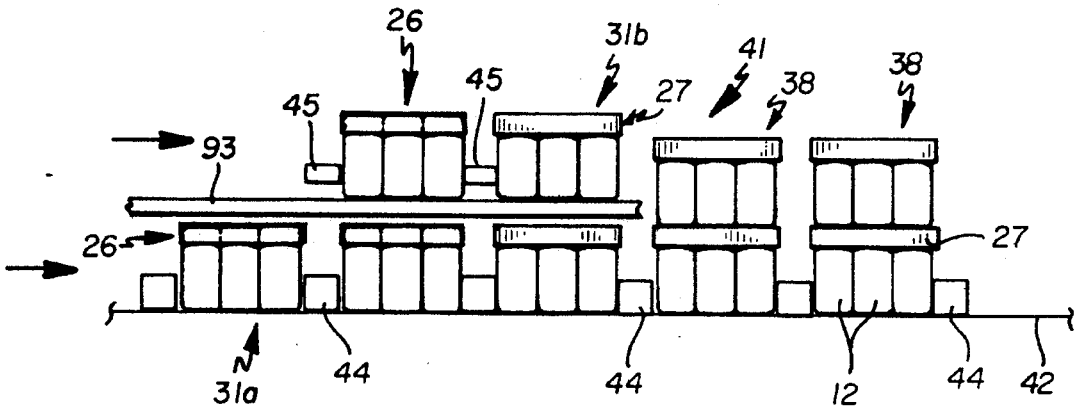
FIG. 8 is a side view of an alternative embodiment of the apparatus of this invention.
FIG. 9 is a block diagram illustrating the placement of the machine sections shown in FIGS. 9*a* and 9b.
FIGS. 9*a* and 9*b* are side views showing details of the mechanism shown in FIG. 1.
Figure 9A:
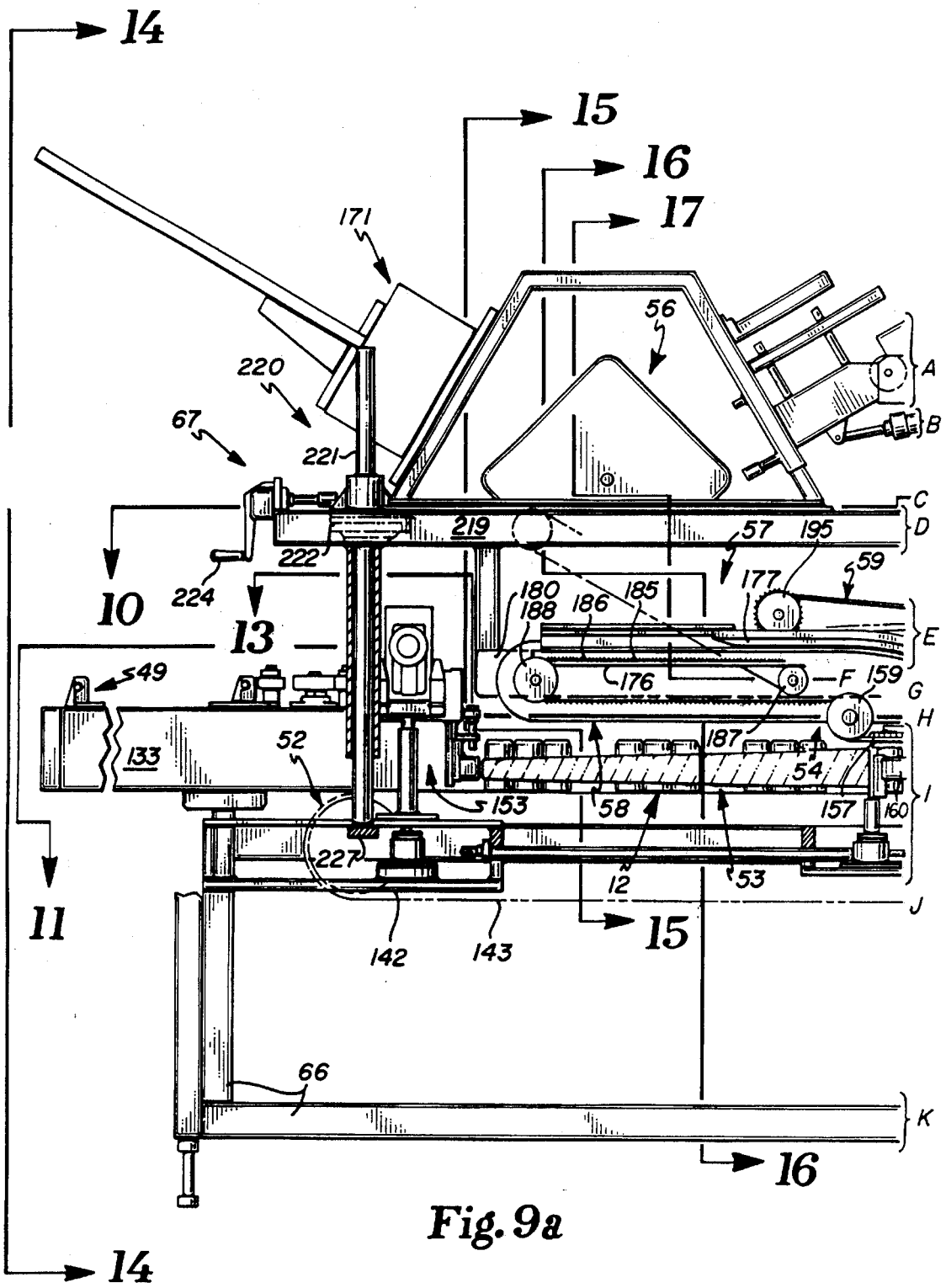
Figure 9B:
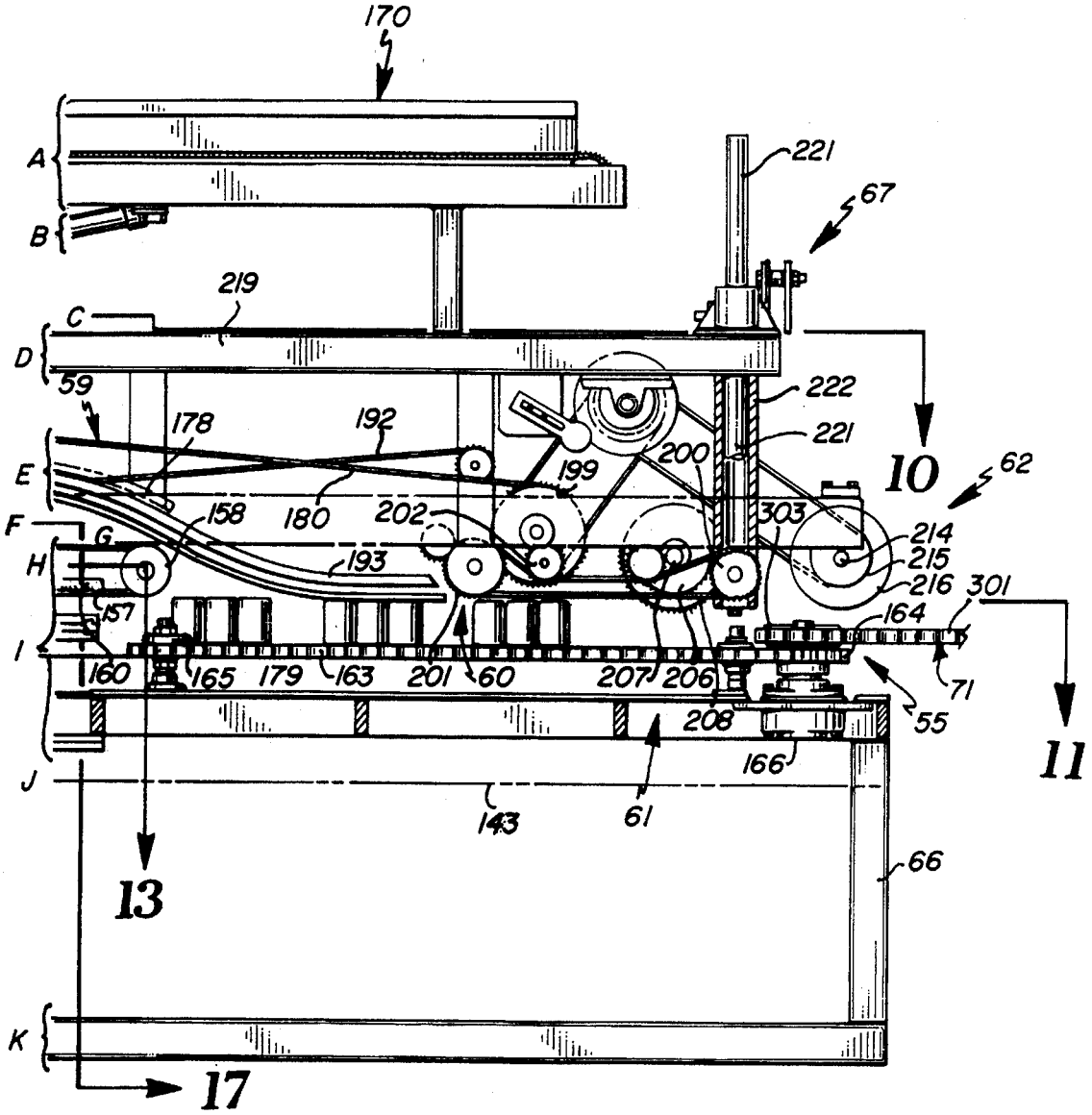

FIG. 8 shows an alternative embodiment of the apparatus 41 for constructing stacked can groups 38 via paperboard clip-type members 26. In this embodiment, the output formed subgroups 31*a* and 31*b* are linearly aligned above one another and transported downstream a predetermined distance. High groups 31*b* traveling on a top conveyor 43 and moved by high lugs or flight bars 45 drop onto aligned low groups 31*a* traveling on low conveyor 42 and moved by lugs or flight bars 44.

FIGS. 9, 10, 11 and 12 show details of the apparatus 10. The infeed conveyors 49 each have a frame 133, a longitudinally oriented side transfer conveyor 50 supported by the frame 133, and a roller platform or base 51. The side transfer conveyors 50 each have a pair of spatially parallel, upstanding, counter revolving endless belts 134 which are separated a predetermined distance equivalent to the width of the respective lane or path 34 or 35 with which they are aligned. The belts 134 are preferably constructed of a flexible polyurethane, with a Kevlar reinforcing cord network. The belts 134 have a plurality of lugs or teeth 135 located on their outwardly disposed faces which are spaced at a distance equivalent to the diameter of the containers 12 processed by the apparatus 10 The lugs 135 also preferably have a fabric backing on their curved contact faces. Each belt 134 is disposed about and continuously driven by a drive pulley (connected to a vertically oriented, axial shaft) 136 and an idler pulley (and shaft) 137. The roller platforms 51 are disposed below the side transfer conveyors 50, in-line with each lane 34 and 35, and provide a low friction support base for articles 12 being translated by the action of the side transfer conveyors 50. The infeed conveyors 49 are shown to be aligned in a side by side orientation and separated a predetermined distance by a center lane divider 65. The lane divider 65 is an elongated, vertically oriented plate structure which extends downstream to a point adjacent the end of the mechanism. The lane divider 65 creates a space or gap of a predetermined width between the two rows of containers traveling in each lane 34 or 35 so that the center rib 28 of the base panel 26 may be depressed therein between as shown and discussed below. Containers 12 are output to the throughput conveyor 52.

The throughput conveyors 52 each comprise a pair of spatially parallel, side by side endless belts 143 and 144 which are disposed about and driven by side by side, driven sprockets (each disposed on a common, axial, transverse and horizontally oriented shaft) 14 located immediately downstream of the infeed conveyor assemblies 50, and side by side idler sprockets (with a common shaft) 142 located at the far downstream end 39 of the apparatus 10 The conveyor belts 143 and 144 have a flat, longitudinally oriented top surface which moves in a downstream direction, and upon which the containers 11 are supported and moved therewith. The belts 143 and 144 preferably have a linked structure, constructed of a rigid plastic material. The belts 143 and 144 have a width which is equivalent to the diameter of a container 12. A longitudinal void area or space 145 separates the belts 143 and 144. The lane dividers 65 are disposed in and above the void area 145.

The infeed timing screw assemblies 53 each comprise a pair of elongated, longitudinally oriented screw members 149 and 150. The inside and outside screw members 149 and 150 are disposed a predetermined distance above and at the sides of the lane 34 or 35 defined by the path of the throughput conveyor 52. The vertical height and horizontal separation distance of the screws 149 and 150 is adjustable to accommodate various size containers. The screws 149 and 150 are connected at their downstream ends to an axially disposed, quick release idler connector 152 and at their upstream end to an axial, quick release drive connector 151. The connectors 151 and 152 allow for easy substitution of screws for conversion from 6 to 4-pack single layer processing. The drive connector 151 is communicatively connected to a common drive mechanism 153. The timing screw assemblies 53 run continuously and operate at a speed which is equivalent to that of the throughput conveyors 52.

The timing screw assemblies 53 receive an unmetered stream of containers 11 from the infeed conveyors 50 and in cooperation with the throughput conveyors 52, separate and meter the containers 12 into predetermined group sizes, 6-packs for example, as they are translated downstream. The individual screw members 149 and 150 have an elongated auger-like configuration with a differentially larger outside diameter at their downstream ends, and which creates a space or gap between trailing members of a newly formed can group and the leading members of the unmetered stream of cans, and then maintains such spacing during downstream conveyance of the now segregated group. Upon output from these assemblies 53, the article groups are spaced preferably on 12 inch centers.

The first overhead containment belt assemblies 54 are disposed at the downstream ends of the infeed timing screw assemblies 53, above each lane 34 and 35. Each belt assembly 54 has an endless belt 157 which is disposed about and driven by a downstream drive pulley 158 and an upstream idler pulley 159, each pulley 158 and 159 revolving about a horizontally oriented, transverse axial shaft. The width of each belt 157 is equivalent to that of the container group. The planar bottom surface of each belt 157 has a predetermined width and is aligned and spaced above the throughput conveyor 52 such that it establishes frictional contact with the container 12 tops. A backing plate 160 is shown disposed to maintain downward pressure on the containers 12. The belts 157 have a width sufficient to cover the entire width of the container group and are preferably constructed of flexible Linatex. The belt assemblies 54 travel at a speed which is equivalent to that of the throughput conveyors 52. The overhead containment belt assemblies 54 align the tops of each container 12 output from the timing screw assemblies 53 prior to processing downstream in the apparatus 10.

The second side transfer conveyors 55 are disposed immediately downstream with respect to the first overhead containment belt assemblies 54, and extend downstream therefrom. Each second side transfer conveyor 55 also includes a pair of spatially parallel, upstanding counter revolving belts 163 disposed about a downstream drive pulley 164 connected to a common, vertically oriented axial drive shaft 166, and an upstream idler shaft/pulley 165, and is operative on product groups 12 traveling in a throughput lane 34 or 35. The belts 163 preferably have a structure which is similar to that of the belts 134 of the first side transfer conveyors 50. The speed of the second side transfer conveyors 55 is equivalent to that of the throughput conveyors 52. The side transfer conveyors 55 function to preserve the spacing between container groups during downstream translation by the throughput conveyor 52 and processing by the remaining elements of the apparatus 10.

The base panel rotary placer 56 is shown disposed on the upper frame 67, above the infeed timing screw assemblies 53. The four apex rotary placer 56 is of a design-type such as that which is disclosed in U.S. Pat. No. 4,530,686, for Rotary Packaging Technology, assigned to Applicants' Assignee. The rotary placer 56 continuously engages base panel blanks 26 at power magazines 170 and transports them in a flat orientation to the infeed ends of the base panel overhead transfer systems 57 which are disposed directly below the placer 56.

Figure 10:
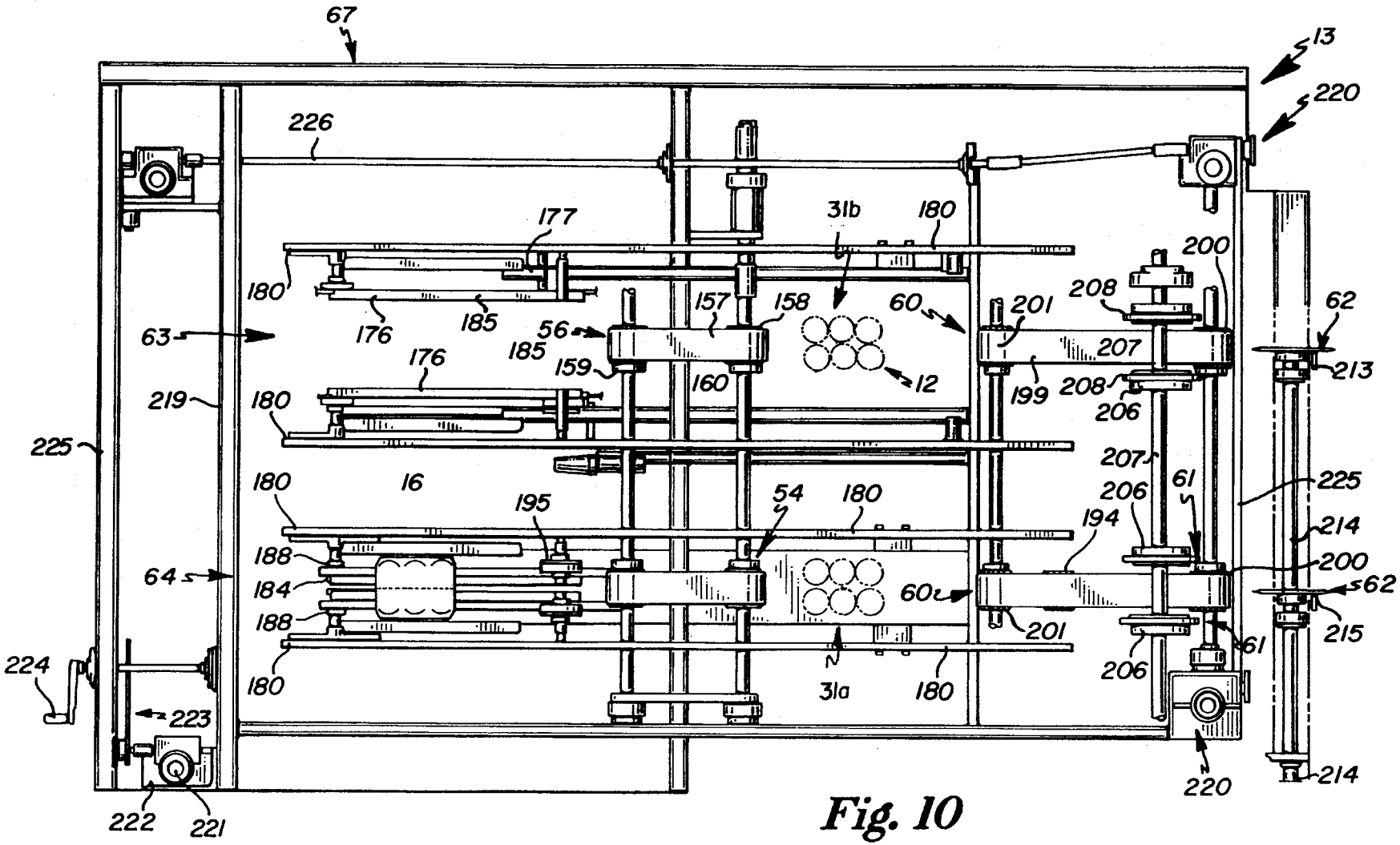
FIG. 10 is a top view of the mechanism as seen along line 10—10 of FIG. 9.
Figure 11:
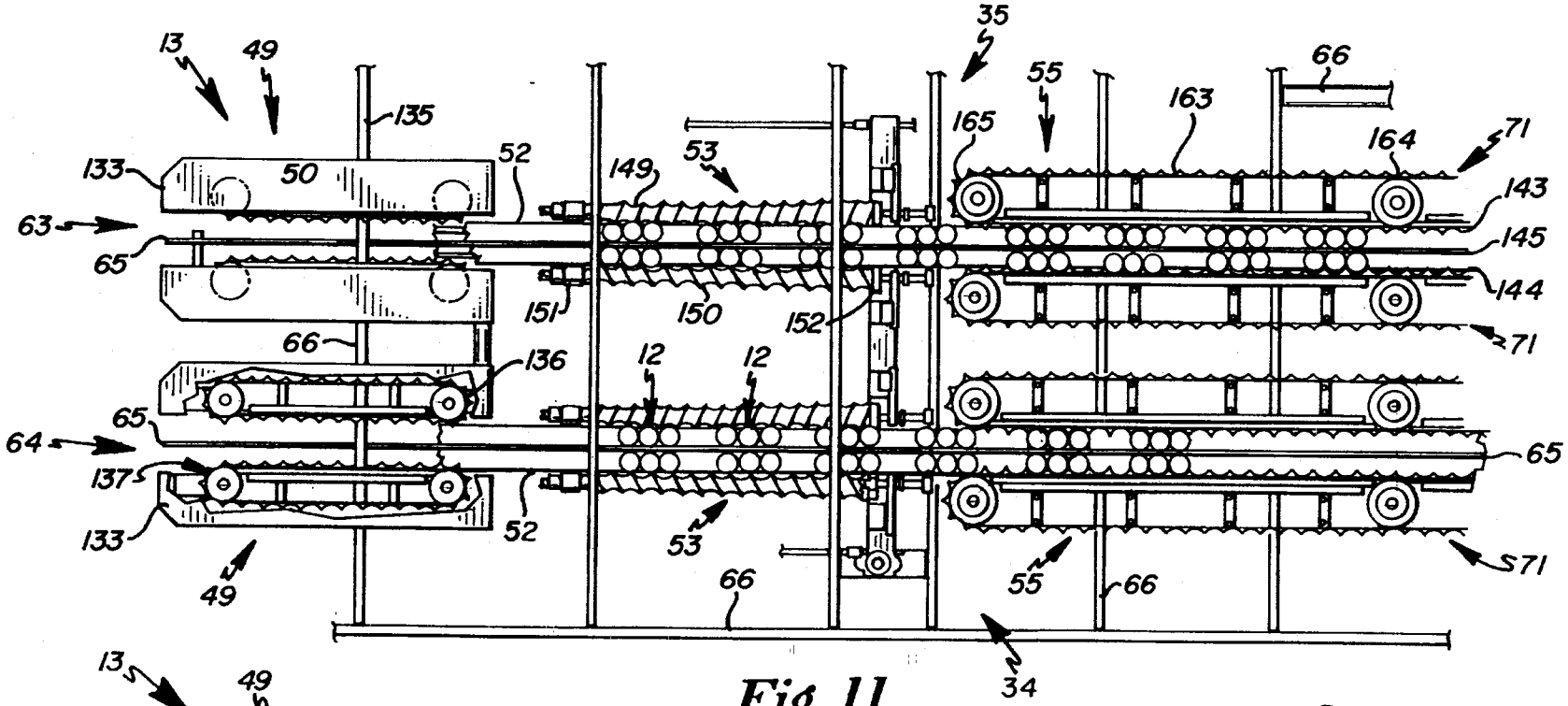
FIG. 11 is a top view of the mechanism as seen along line 11—11 of FIG. 9.
Figure 12:
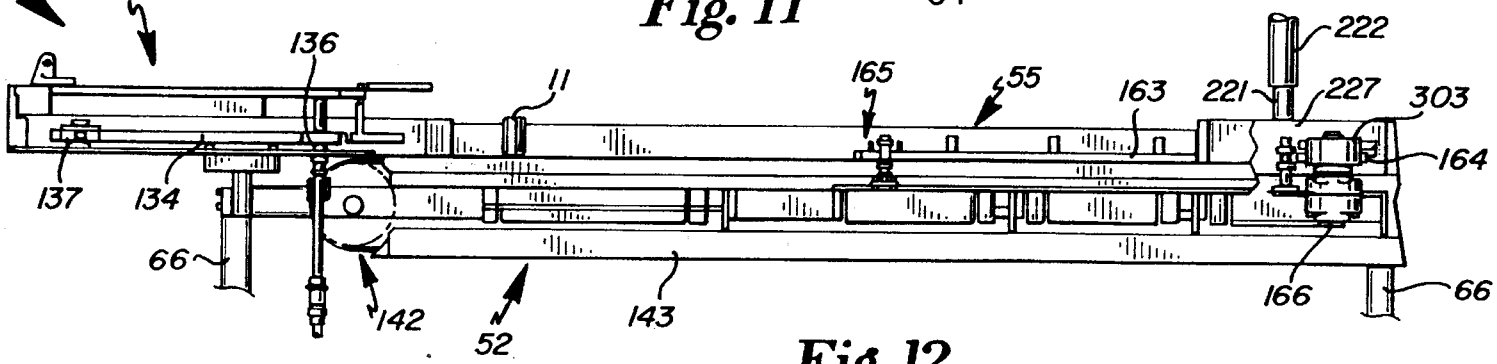
FIG. 12 is a side view of a lower portion of the mechanism.
Figure 13:
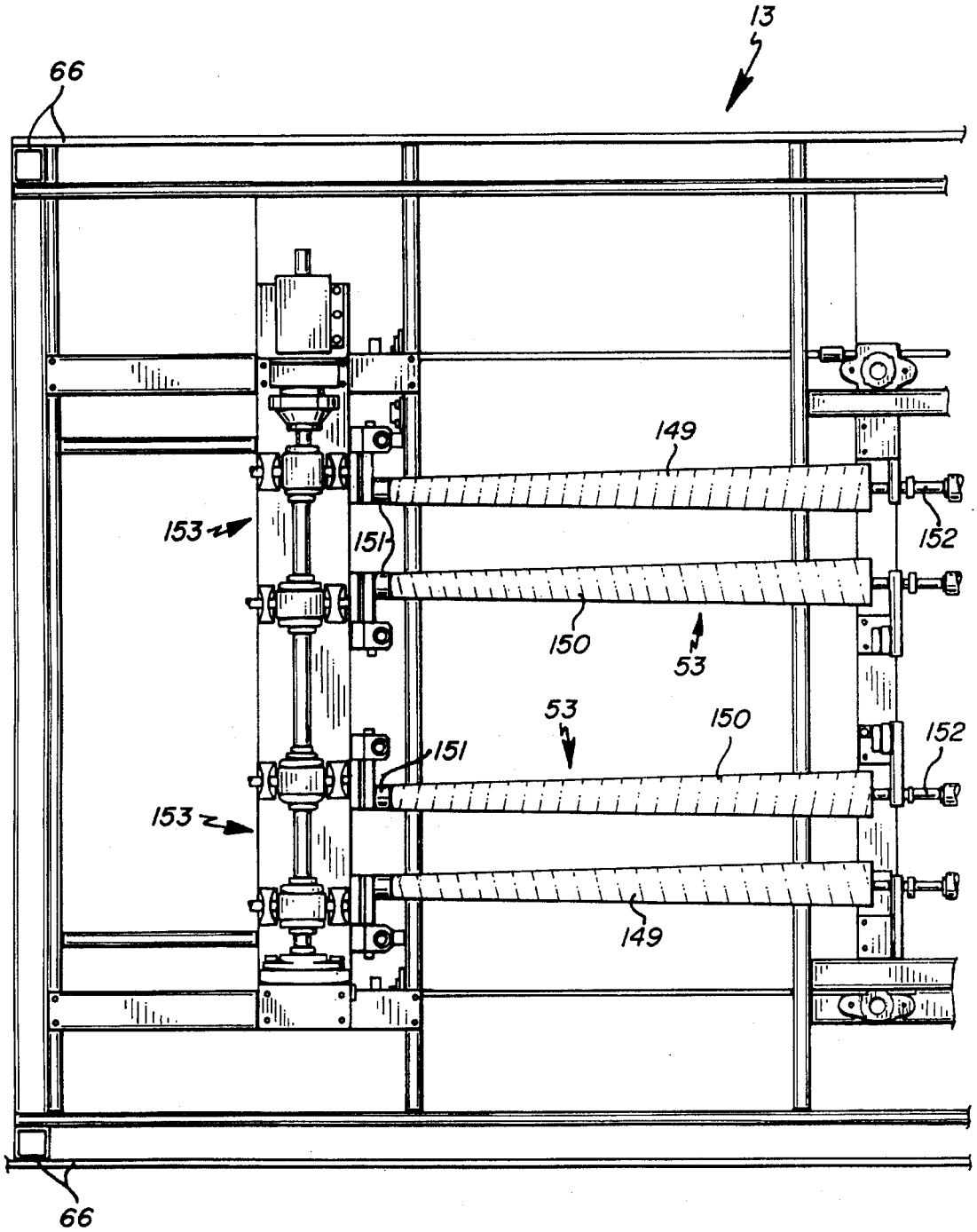
FIG. 13 is a top view of a portion of the mechanism as seen along line 13—13 of FIG. 9.
Figure 14:
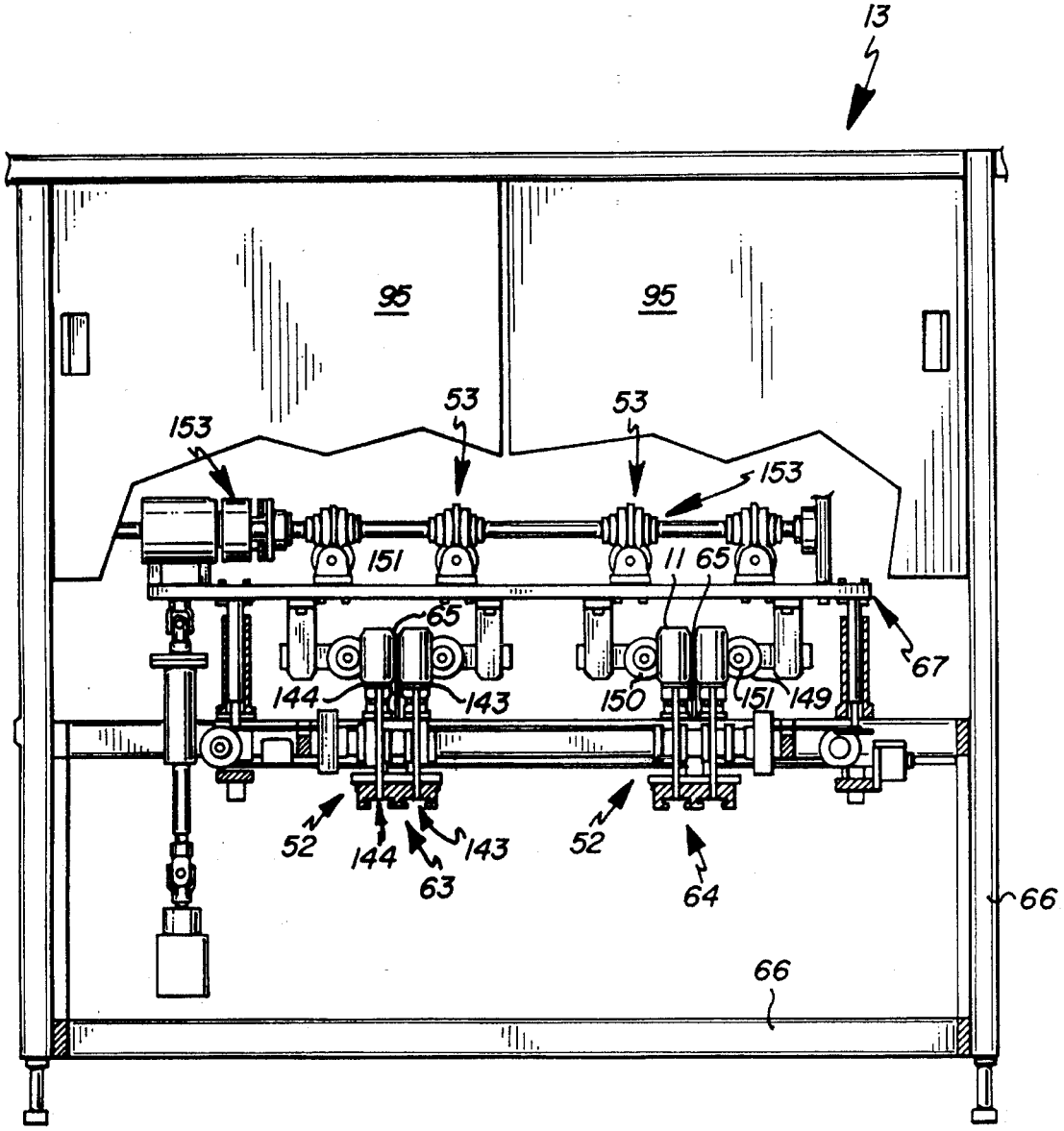
FIG. 14 is an end view, partially in crossection, of the mechanism as seen along line 14—14 of FIG. 9.
Figure 15:
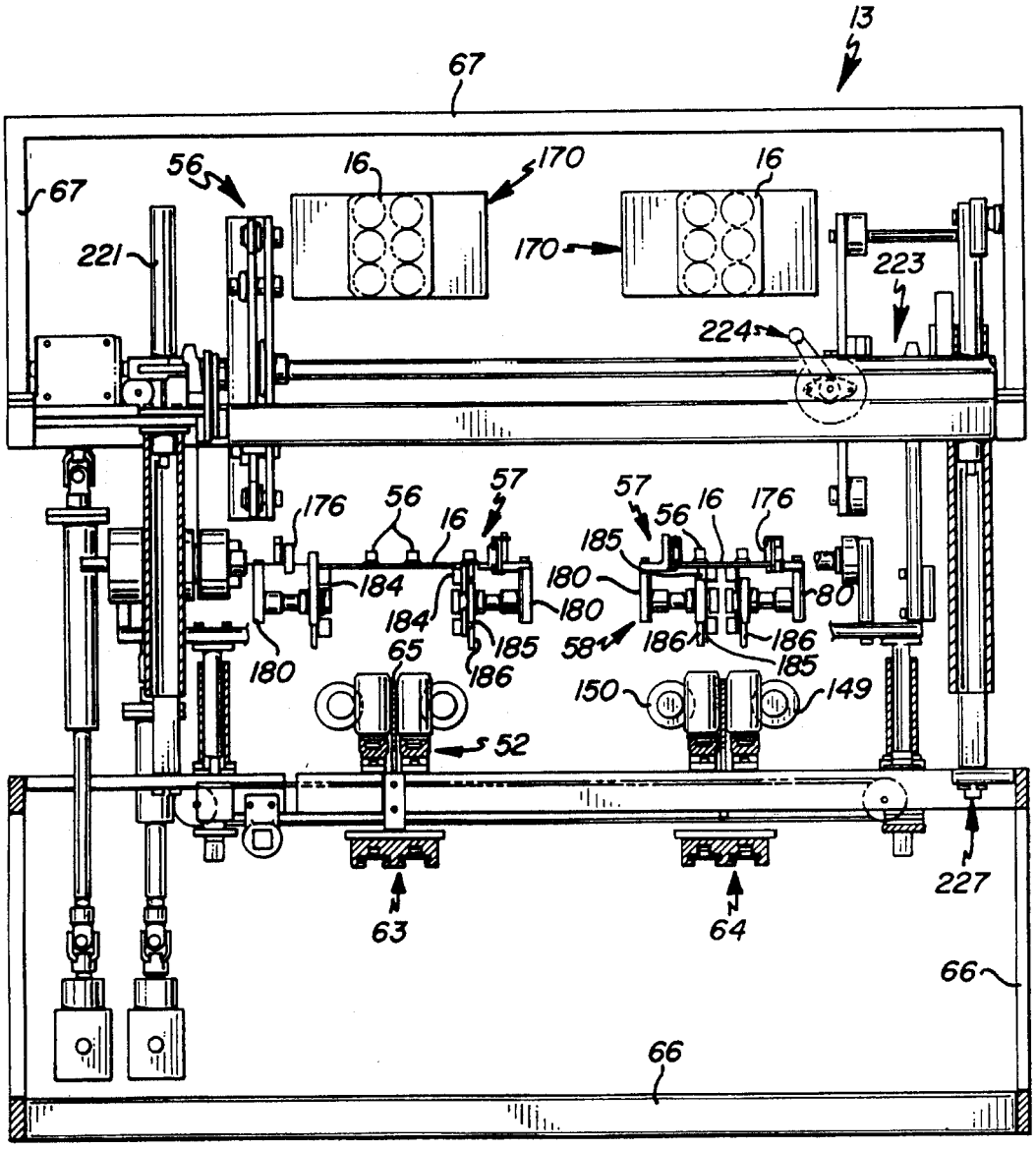
FIG. 15 is a crossectional view of the mechanism taken along line 15—15 of FIG. 9.
Figure 16:
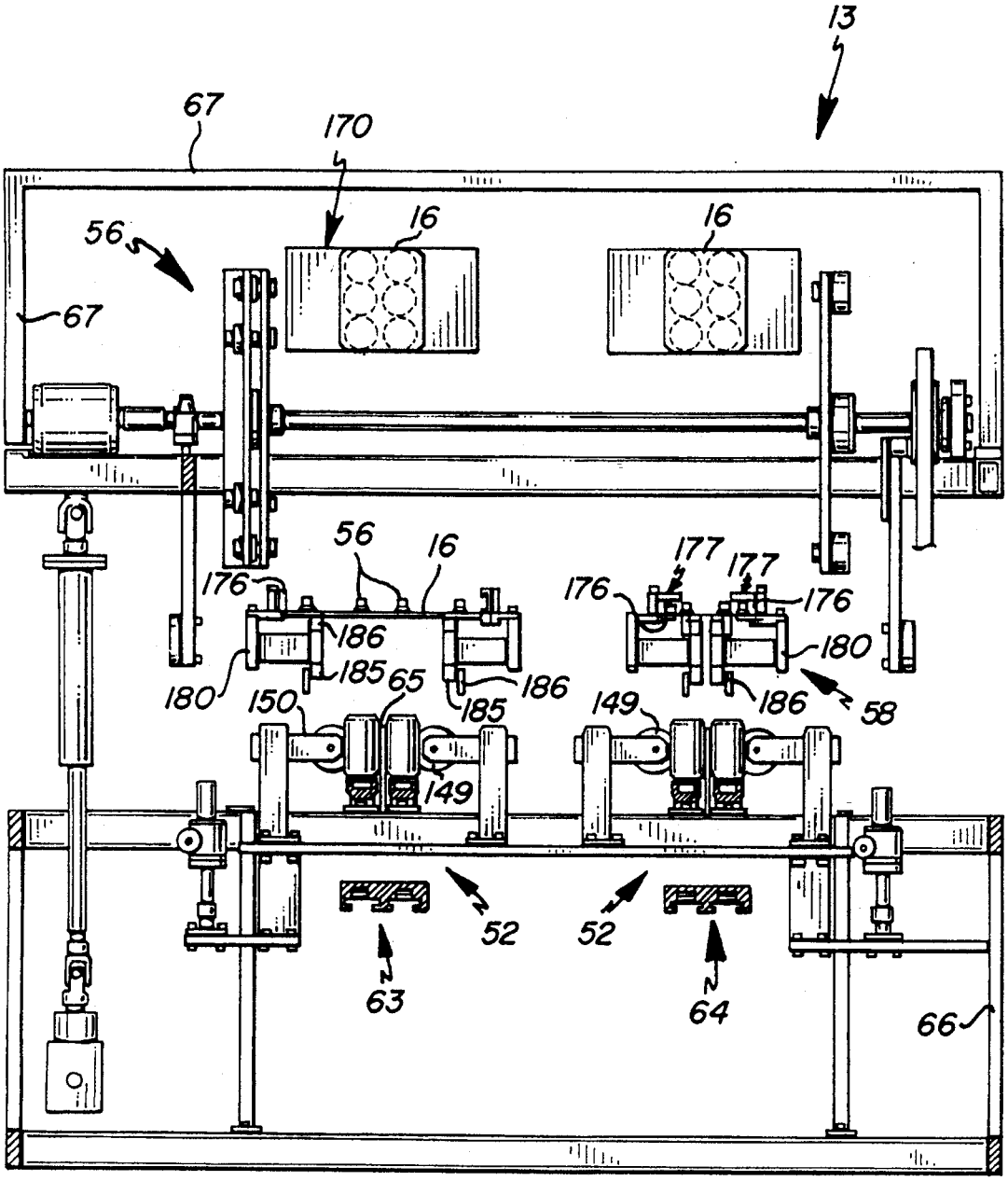
FIG. 16 is a crossectional view of the mechanism taken along line 16—16 of FIG. 9.
Figure 17:
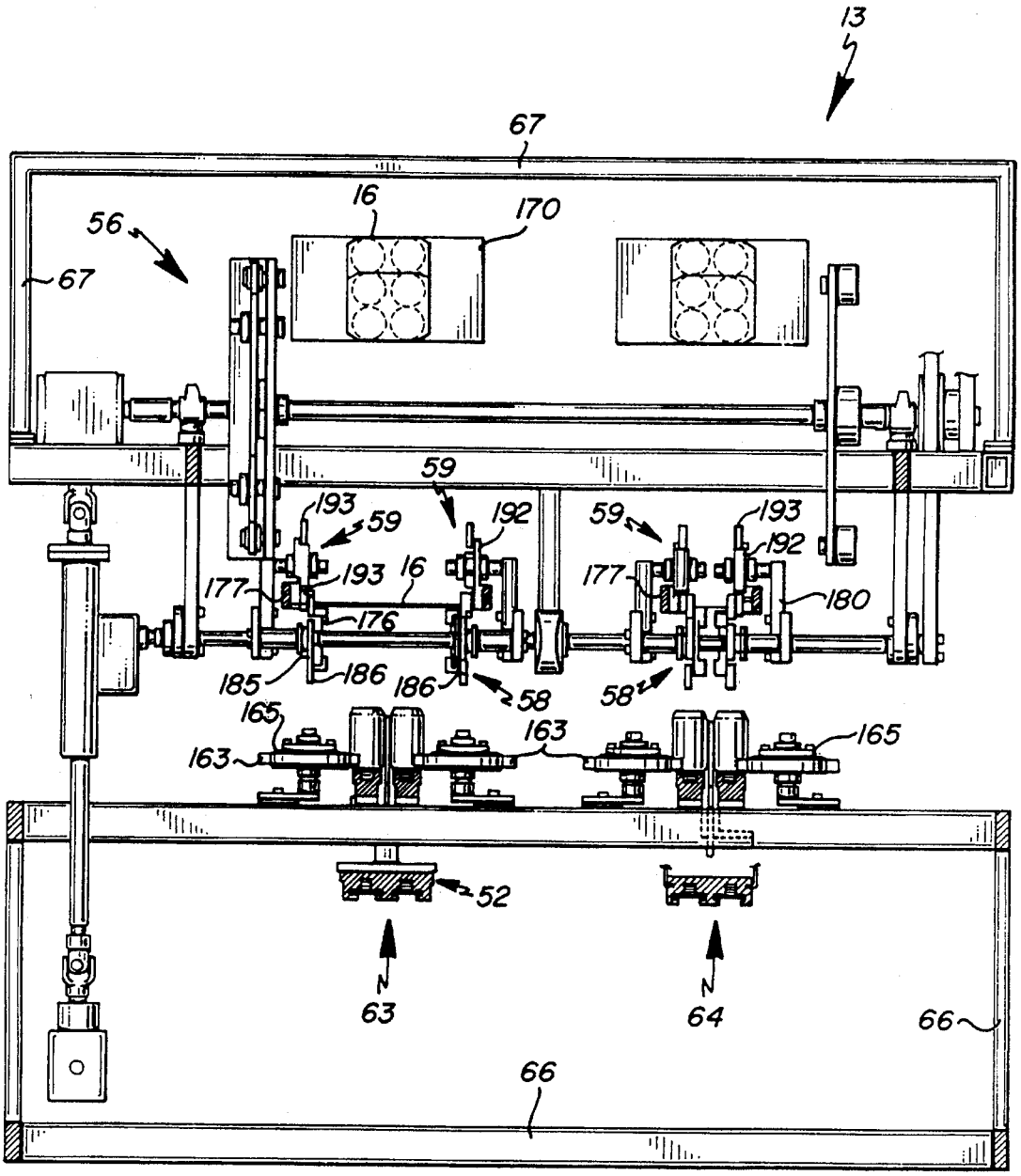
FIG. 17 is a crossectional view of the mechanism taken along line 17—17 of FIG. 9.

Referring also to FIGS. 9 and 10, the base panel overhead transfer systems or carriages 57 basically comprise a support structure 180, guide rail means, a lower or proximal lug conveyor 58 and an upper or distal lug conveyor 59. The support structure 180 includes a pair of spatially parallel, longitudinally oriented bars located above the throughput conveyor 52 and which are attached to the upper frame 67. The guide rail means includes a pair of spatially parallel, longitudinally oriented bottom rails 176 and a pair of top rails 177 which are coupled to the bottom rails 176. The bottom rails 176 are disposed directly above the timing screw assemblies 53, and below the rotary placer 56 for reception of the base panel blanks 26 therefrom, and extend a predetermined downstream distance. Each bottom rail 176 further has an L-shaped crossectional configuration with an upwardly oriented vertical member and an inwardly oriented horizontal member. The bottom rails 176 are spatially separated a predetermined distance equal to the width of a blank 26, whereby the blanks 26 are deposited by the placer 56 between the vertical members, and the horizontal members support the side edges of the blank 26. The bottom rails 176 are preferably constructed of a low friction polymeric material. The rails 176 are horizontally, laterally movable so that the distance between the rails 176 is adjustable to accommodate various widths of blanks 26.

The bottom rails 176 extend longitudinally downstream in a horizontal plane for a predetermined distance and subsequently slope downwardly through a predetermined downstream distance until they are at a vertical level which is just above the top of the container groups. The bottom rails 176 level off horizontally at that height, extend downstream a final predetermined distance, and terminate. At their downstream end, the horizontal members of the bottom rails 176 terminate to allow the base panel blanks 26 to drop onto the synchronized, aligned moving container groups.

The top guide rails 177 are disposed over the bottom rails 176 such that the resulting rail pair 176–177 forms a groove in which the base panel 26 lateral edges slidingly travel. The top rails 177 begin at the end of the upstream horizontal portion of the bottom rails 176, to permit placement of the blanks 26 thereon, and extend coextensively downstream with the bottom rails 176. The top rails 177 also have a chain guide groove in which a portion of the upper lug conveyor 59 is slidingly engaged, as is discussed below. The top guide rails 177 are also preferably constructed of a plastic material.

Base panel blanks 26 are moved along the rails 176 and 177 of the overhead transfer system 57 by the lower lug conveyor 58 and the upper lug conveyor 59. The lower lug conveyor 58 is disposed generally below the upstream horizontal portion of the bottom rails 176 and longitudinally conveys blanks 26 there through. The lower lug conveyor 58 includes a pair of longitudinally oriented, spatially parallel endless chains 185 which are rotatably disposed on and driven by a downstream drive pulley 187 and an upstream idler pulley 188, each with a transverse and horizontally oriented shaft. The spaced chains 185 revolve and form a generally planar, downstream moving upper path between the spaced lower rails 176. The planar upper path formed by the chains 185 is flush with the level of the bottom rails 176 and extends substantially the length of the upstream horizontal portion of the bottom rails 176. A pair of elongated, spatially parallel, longitudinally oriented bottom dead plates 175 is preferably disposed between the chains 185 to provide support to the central rib portion 18 of the blanks 16 during transport. The plates 175 extend the length of the upstream horizontal portion of the bottom rails 176, and are generally coextensive with the planar upper path of chains 185. A plurality of outwardly extending trailing lugs 186 are connected to each chain 185 at intervals at least as large as the length of each blank 16 to allow for insertion of a blank 16 anterior to each lug 186 pair, the lugs 186 of each chain 185 being aligned with each other in such pairs to provide two trailing driving points for each blank 26.

The upper lug conveyor 59 is disposed generally above the downstream sloping and horizontal portions of the bottom and top guide rails 176 and 177, and longitudinally conveys blanks 26 therethrough. The upper lug conveyor 59 includes a pair of longitudinally oriented, spatially parallel endless chains 192 which are rotatably disposed in and driven by a downstream drive pulley and transverse, horizontally oriented shaft 194 and an upstream idler pulley and shaft 195. The chains 192 are spaced so that they form a lower, downstream moving path which moves in and is guided by the chain guide groove in the upper guide rails 177. A plurality of inwardly extending trailing lugs 193 are connected to each chain 192 at intervals at least as large as the length of each blank 26. The lugs 193 of the separate chains 192 are aligned in pairs. Base panel blanks 26 are transported by the lower and upper lug conveyors 58 and 59 on the overhead transfer systems 57 at the same rate as article groups traveling on the throughput conveyors 52.

A base blank bias mechanism is disposed centrally between the upper lug conveyor chains 193 above the sloping portion of the bottom and top guide rails 176 and 177. The base blank bias mechanism urges the central rib portion 28 of the blanks 26 downwardly as the edges of the blanks 26 travel in the sloping groove formed between the rails 176 and 177. The bias mechanism includes an elongated, longitudinally oriented support bar 178 and approximately four flexible arms 179 which are connected to the support bar 178 at a top end and extend downwardly therefrom at an angle for contact with the blanks 26 at their opposite end.

The second overhead containment belt assemblies 60 are disposed immediately adjacent the downstream end of their respective base panel overhead transfer systems 57, and above each lane 34 and 35. Each assembly 60 has an endless flexible belt 199 which is disposed about and driven by a downstream drive pulley 200, roller guides 202, and an upstream idler pulley 201, each pulley 200 and 201 being coupled to a horizontally oriented, transverse axial shaft. The planar bottom surface of the belt 199 has a width which is slightly less than that of the base panel 26 to allow the panel side strips 27 to be exposed for contact with the outside chime locking wheel assemblies 61. The belt 199 bottom surface is adjustably spaced above the throughput conveyor 52 so that it contacts the top surface of the base panel 26, and travels at a rate equivalent to the throughput conveyor 52.

The outside chime locking wheel assemblies 61 are disposed at the downstream level of the second overhead containment belt assembly 60 output ends. The assemblies 61 have a transverse, horizontally disposed common drive shaft 207 which is disposed above the level of the throughput conveyor 52. A freewheel, non-driven shaft 207 may alternatively be utilized, wherein the assembly 61 rotates via the action of the conveyed article groups. A pair of wheel hubs 206 are attached to the shaft 207 adjacent each throughput lane 34 and 35, one hub 206 being placed at each side of and above each lane 34 or 35. The flat plane of each hub 206 is vertically and longitudinally oriented. Each hub 206 has a peripheral wheel rim 208. The wheel rims are preferably constructed of flexible polyurethane and have a pair of opposing flat edges (not shown). The outside diameter of the wheel rims 208, the height of the drive shaft 207 above the conveyor 52, and the spacing of the hubs 206 thereon are such that the rim 208 periphery urges the base panel side strips 27 downwardly during longitudinal transport so that the curved slits 30 engage the outwardly facing portions of the top circumferential rims or chimes of the containers 12.

The inside chime locking wheel assemblies 62 are disposed slightly downstream of the second overhead containment belt assemblies 60. The assemblies 62 have a transverse, horizontally disposed common drive shaft 214 (driven or non-driven) disposed above the throughput conveyor 52. A wheel hub 213 is attached to the drive shaft 214, centered above each lane 34 and 35. The flat plane of each hub 213 is vertically and longitudinally oriented. Each hub 213 has a peripheral wheel rim 215, which is preferably constructed of stainless steel or the like and has a circumferential groove therein. A urethane O-ring (not shown) is disposed in the groove. The outside diameter of the wheel rims 215 and the height of the drive shaft 214 above the conveyor 52 are such that the rim 215 periphery urges the base panel center rib 28 downwardly so that the curved slits 30 engage the inwardly facing portions of the top circumferential chimes of the containers 12.

As was previously mentioned, the timing screw assemblies 53, the first overhead containment belt assemblies 54, the base panel rotary placer 56, the base panel overhead transfer system 57, the second overhead containment belt assemblies 60 and the outside and inside chime locking wheel assemblies 61 and 62 are all disposed on an upper frame structure 67 to provide adjustability and/or convertibility of packaging. The upper frame 67 includes a network of spaced and connecting horizontal members 219 which are connected to adjustable jacks 220 located at four corner positions. The jacks 220 have vertically disposed cylindrical posts 221 which are mounted at their bottom ends to the main frame 66 via post mounts 227, cylindrical hollow sleeves 222 which ride on the posts 221 and drive gears 2. A hand crank 224 is connected to one of the drive gears 223. The drive gears 223 are shown to be communicatively connected by synchronizing drive chains 225 and shafts 226 so that all four jacks 220 may be simultaneously operated from the single crank 224.

In summary, the apparatus processes a pair of unmetered streams of articles 11 into two streams of predetermined groups retained by base panels 26. The infeed conveyors 49 uniformly feed containers 12 to the product paths 34 and 35 and further form a gap between the two rows of containers 11 forming each path 34 or 35. The throughput conveyors 52 receive containers 12 from the infeed conveyor assemblies 49 and subsequently are primary responsible for transporting them in the conveyance paths 34 and 35. The infeed timing screw assemblies 53 separate the streams of containers into predetermined groups 12. Article groups conveyed in lanes 34 and 35 emerge immediately downstream of the first overhead containment belt assemblies 54 in a condition for engagement with the base panels 26. They have a level top surface and a slight longitudinally oriented central gap between the two rows of three containers 12. As each group is conveyed in a stable, spaced orientation by the throughput conveyors 52 and the second side transfer conveyors 55 it is aligned with a base panel 26 traveling above it on an overhead transfer system 57. At the downstream horizontal portion of each system 57, a synchronized base panel 26 is deposited on the top surface of a group. They are then conveyed under the second overhead containment belt assemblies 60 where pressure is exerted on the top of the base panel 26 to hold it in position on the container group 12. At the downstream end of the second overhead containment belt assemblies 60, the strips 27 of each panel 26 are locked down on the container group by the outside chime locking wheel assemblies 61, while the group is still under the control of a containment belt assembly 60. And subsequently, the central rib 28 of the panel 26 is locked down by the inside chime locking wheel assemblies 62, prior to output from the apparatus 10.

Although the apparatus 10 is shown utilized in a 12-pack (6/6) beverage can packaging operation, modifications consistent with the teachings of this invention may be made to package various other stacked carrier configurations. As many changes are possible to the embodiments of this invention utilizing the teachings thereof, the descriptions above, and the accompanying drawings should be interpreted in the illustrative and not the limited sense.

That which is claimed is:

1. An apparatus for assembling stacked article group carriers, comprising:

a) an article grouping and clip-type carrier application assembly, said assembly having at least one input and first and second output lines, and comprising:

i) two pairs of longitudinally oriented generally spatially parallel screw structures, each pair being separated a predetermined distance and disposed above one said conveyance path, said pairs of screw structures generating two metered, linear streams of article groups;

ii) a conveyor assembly constructed and arranged to receive said streams of article groups from said screw structures and longitudinally translate said groups in a pair of side by side, downstream conveyance paths;

iii) an overhead transfer mechanism constructed and arranged above each said conveyor assembly to deposit a clip-type carrier onto a top surface of at least one said article group traveling thereon; and iv) means to bring said clip-type carrier into mating engagement with said top surface of at least one said article group;

b) a first conveyor disposed to receive and transport first article groups having clip-type carriers attached thereto from said first output line, said first article groups being transported at a first vertical level;

c) a second conveyor disposed to receive and transport second article groups having clip-type carriers attached thereto from said second output line, said second article groups being transported at a second vertical level which is above said first vertical level; and d) means to merge said second article groups over the top surface of said first article groups.

2. The apparatus of claim 1, wherein said input means further comprises a side transfer conveyor assembly disposed upstream with respect to each said pair of screw structures.

3. The apparatus of claim 1, wherein said conveyor assembly further comprises at least one endless belt structure having a longitudinally oriented top surface defining said conveyance path for support of a bottom surface of said article groups.

4. The apparatus of claim 3, wherein said conveyor assembly further comprises at least one second side transfer conveyor assembly for maintaining the metered position of article groups in said stream of article groups translated in said conveyance path, said at least one side transfer conveyor being constructed and arranged so that it is operative over a downstream distance coextensive with respect to said endless belt structure top surface.

5. The apparatus of claim 1, wherein said overhead transfer mechanism comprises bi-level guide means having a first end disposed at a first height above said conveyor assembly and a second end located downstream with respect to said first end and at a second, lower height above said conveyor assembly, means to supply clip-type carrier blanks at said first end of said guide means, and means to convey said carriers to said second end of said guide means, whereby said carriers are deposited on said top surface of said article group.

6. The apparatus of claim 5, wherein said overhead transfer mechanism guide means includes a pair of spatially parallel tracks separated a predetermined distance generally equivalent to the width of said carrier, said tracks having open top surfaces at said first end and open bottom surfaces at said second end, said tracks further being downwardly sloped between said first and second ends.

7. The apparatus of claim 6, wherein said supply means consists of a rotary placer apparatus and a magazine, said rotary placer apparatus continuously transferring carriers from said magazine disposed at a first position to said guide means first end disposed at a second position below said first position.

8. The apparatus of claim 6, wherein said overhead transfer mechanism conveyance means includes a first section having at least one driven, endless chain with a plurality of upwardly extending lug members spaced thereon at predetermined intervals generally equivalent to the length of said carrier, said first section being disposed and operative along a first predetermined segment of one said guide means tracks, and a second section having at least one driven, endless chain with a plurality of downwardly extending lug members spaced thereon at predetermined intervals generally equivalent to the length of said carrier, said second section being disposed and operative along a second predetermined segment of said guide means tracks.

9. The apparatus of claim 6, wherein said overhead transfer mechanism further comprises means to downwardly bias said carrier at said second end of said guide means.

10. The apparatus of claim 1, wherein said engagement means comprises an overhead containment assembly constructed and arranged above said conveyor assembly, downstream from said overhead transfer mechanism, said overhead containment assembly including at least one endless belt having a longitudinally oriented bottom surface for contact with a top surface of said article groups.

11. The apparatus of claim 10, wherein each said clip-type carrier is constructed of paperboard and has a predetermined slotted engagement pattern for mating with a top surface of one said article group, and wherein said engagement means further comprises at least one disc-shaped, rotatable plow for urging said slotted engagement pattern into mating engagement with the top surface of said article group.

12. The apparatus of claim 1, wherein said overhead transfer mechanism and said engagement means are supported on a frame structure which is vertically movable with respect to said input means and said conveyor assembly, whereby said overhead transfer mechanism and said engagement means is removable from operation on article groups translated by said conveyor assembly.

13. The apparatus of claim 1, wherein:

i) said clip type carriers are constructed of paperboard and have a predetermined slotted engagement pattern for mating with a top surface of said article groups;

ii) said input means comprises pairs of longitudinally oriented generally spatially parallel screw structures, each pair being separated a predetermined distance and disposed above a respective said conveyance path, and a side transfer conveyor assembly disposed upstream with respect to said screw structures; and iii) said engagement means comprises an overhead containment assembly constructed and arranged above said conveyor assembly downstream from said overhead transfer mechanism, said overhead containment assembly including at least one endless belt having a longitudinally oriented bottom surface for contact with a top surface of said article groups, said engagement means further comprising at least one disc-shaped, rotatable plow for urging said carrier base member slotted engagement pattern into mating engagement with the top surface of said articles.

14. The apparatus of claim 1, wherein said first and second conveyors are disposed side by side of one another, and wherein means to merge comprises an angled segment of said second conveyor which intersects said first conveyor at a predetermined angle.

15. The apparatus of claim 1, wherein said first and second conveyors are disposed in-line with one another, and wherein said means to merge comprises a terminal end of said second conveyor, whereby article groups traveling on said second conveyor drop off said terminal end onto synchronized article groups traveling on said first conveyor.

16. The apparatus of claim 1, further comprising means to apply a fastener to the top surface of each said first and second article group, said means to apply a fastener being disposed upstream of said means to merge.

17. An apparatus for assembling stacked article group carriers, comprising:

a) an article grouping and clip-type carrier application assembly, said assembly having at least one input and first and second output lines, and comprising:

i) means to input two metered, linear streams of article groups;

ii) a conveyor assembly constructed and arranged to receive said streams of article groups from said input means and longitudinally translate said groups in a pair of side by side, downstream conveyance paths;

iii) an overhead transfer mechanism constructed and arranged above each said conveyor assembly to deposit a clip-type carrier onto a top surface of at least one said article group traveling thereon, said overhead transfer mechanism including means to supply clip-type carrier blanks, means to convey said carrier blanks, and means to guide said carrier blanks, said conveyance means comprising at least two lugged chains; and iv) means to bring said clip-type carrier into mating engagement with said top surface of at least one said article group;

b) a first conveyor disposed to receive and transport first article groups having clip-type carriers attached thereto from said first output line, said first article groups being transported at a first vertical level;

c) a second conveyor disposed to receive and transport second article groups having clip-type carriers attached thereto from said second output line, said second article groups being transported at a second vertical level which is above said first vertical level; and d) means to merge said second article groups over the top surface of said first article groups.

18. An apparatus for assembling stacked article group carriers, comprising:

a) an article grouping and clip-type carrier application assembly, said assembly having at least one input and first and second output lines, and comprising:

i) means to input two metered, linear streams of article groups;

ii) a conveyor assembly constructed and arranged to receive said streams of article groups from said input means and longitudinally translate said groups in a pair of side by side, downstream conveyance paths;

iii) an overhead transfer mechanism constructed and arranged above each said conveyor assembly to deposit a clip-type carrier onto a top surface of at least one said article group traveling thereon, said overhead transfer mechanism including means to supply clip-type carrier blanks, means to convey said carrier blanks, means to guide said carrier blanks and means to downwardly bias said carrier on said guide means; and iv) means to bring said clip-type carrier into mating engagement with said top surface of at least one said article group;

b) a first conveyor disposed to receive and transport first article groups having clip-type carriers attached thereto from said first output line, said first article groups being transported at a first vertical level;

c) a second conveyor disposed to receive and transport second article groups having clip-type carriers attached thereto from said second output line, said second article groups being transported at a second vertical level which is above said first vertical level; and d) means to merge said second article groups over the top surface of said first article groups.

19. An apparatus for assembling stacked article group carriers, comprising:

a) an article grouping and clip-type carrier application assembly, said assembly having at least one input and first and second output lines, and comprising:

i) means to input two metered, linear streams of article groups;

ii) a conveyor assembly constructed and arranged to receive said streams of article groups from said input means and longitudinally translate said groups in a pair of side by side, downstream conveyance paths;

iii) an overhead transfer mechanism constructed and arranged above each said conveyor assembly to deposit a clip-type carrier onto a top surface of at least one said article group traveling thereon;

iv) means to bring said clip-type carrier into mating engagement with said top surface of at least one said article group; and v) a frame structure supporting said overhead transfer mechanism and said engagement means, said frame structure being vertically movable with respect to said input means and said conveyor assembly to permit removal of said overhead transfer mechanism and said engagement means from operation on article groups translated by said conveyor assembly;

b) a first conveyor disposed to receive and transport first article groups having clip-type carriers attached thereto from said first output line, said first article groups being transported at a first vertical level;

c) a second conveyor disposed to receive and transport second article groups having clip-type carriers attached thereto from said second output line, said second article groups being transported at a second vertical level which is above said first vertical level; and d) means to merge said second article groups over the top surface of said first article groups.

20. An apparatus for assembling stacked article group carriers, comprising:

a) an article grouping and clip-type carrier application assembly, said assembly having at least one input and first and second output lines, and comprising:

i) means to input two metered, linear streams of article groups;

ii) a conveyor assembly constructed and arranged to receive said streams of article groups from said input means and longitudinally translate said groups in a pair of side by side, downstream conveyance paths;

iii) an overhead transfer mechanism constructed and arranged above each said conveyor assembly to deposit a clip-type carrier onto a top surface of at least one said article group traveling thereon; and iv) an overhead containment assembly constructed and arranged above said conveyor assembly downstream from said overhead transfer mechanism, said overhead containment assembly including at least one endless belt having a longitudinally oriented bottom surface for contact with a top surface of said article groups, said engagement means further comprising at least one disc-shaped rotatable plow operable on said clip-type carrier;

b) a first conveyor disposed to receive and transport first article groups having clip-type carriers attached thereto from said first output line, said first article groups being transported at a first vertical level;

c) a second conveyor disposed to receive and transport second article groups having clip-type carriers attached thereto from said second output line, said second article groups being transported at a second vertical level which is above said first vertical level; and d) means to merge said second article groups over the top surface of said first article groups.

* * * * *